US006253045B1

(12) United States Patent
Blair et al.

(10) Patent No.: US 6,253,045 B1
(45) Date of Patent: Jun. 26, 2001

(54) MULTI-LEVEL OILING DEVICE DRIVE MECHANISM

(75) Inventors: Bryan Michael Blair; Edward Alan Rush; Krikor Yosmali, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/548,928

(22) Filed: Apr. 13, 2000

(51) Int. Cl.[7] ..... G03L 15/20
(52) U.S. Cl. ..... 399/122; 399/325
(58) Field of Search ..... 399/122, 325, 399/326, 352

(56) References Cited

U.S. PATENT DOCUMENTS

| | | | |
|---|---|---|---|
| 3,186,838 | | 6/1965 | Graff et al. . |
| 3,649,992 | | 3/1972 | Thettu . |
| 3,706,491 | | 12/1972 | Furman et al. . |
| 3,868,744 | | 3/1975 | Thettu . |
| 4,040,383 | | 8/1977 | Vandervort . |
| 4,049,213 | | 9/1977 | Hank et al. . |
| 4,111,378 | | 9/1978 | Barwick . |
| 4,151,403 | | 4/1979 | Woolston . |
| 4,456,193 | | 6/1984 | Westover . |
| 4,485,982 | | 12/1984 | St. John et al. . |
| 4,535,950 | | 8/1985 | Linsyanski . |
| 4,557,588 | * | 12/1985 | Tomosada ..... 399/352 |
| 4,791,447 | | 12/1988 | Jacobs . |
| 4,835,698 | | 5/1989 | Beery et al. . |
| 4,899,197 | | 2/1990 | Davis et al. . |
| 4,913,366 | | 4/1990 | Andou . |
| 5,045,890 | | 9/1991 | DeBolt et al. . |
| 5,170,214 | | 12/1992 | Negoro et al. . |
| 5,202,734 | | 4/1993 | Pawlik et al. . |
| 5,218,410 | | 6/1993 | Nkabayashi et al. . |
| 5,221,948 | | 6/1993 | Dalal . |
| 5,280,274 | | 1/1994 | Uemura et al. . |
| 5,289,246 | | 2/1994 | Menjo . |
| 5,323,217 | | 6/1994 | Christy et al. . |
| 5,327,203 | * | 7/1994 | Rasch et al. . |
| 5,353,107 | | 10/1994 | Sculley et al. . |
| 5,420,678 | | 5/1995 | Rasch et al. . |
| 5,452,065 | | 9/1995 | Bell . |
| 5,482,552 | | 1/1996 | Kikukawa et al. . |
| 5,506,669 | | 4/1996 | Inoue et al. . |
| 5,594,540 | | 1/1997 | Higaya et al. . |
| 5,609,685 | | 3/1997 | Fux . |
| 5,625,859 | | 4/1997 | Moser . |
| 5,678,133 | | 10/1997 | Siegel . |
| 5,749,036 | | 5/1998 | Yoda et al. . |
| 5,797,063 | | 8/1998 | Umezawa et al. . |
| 5,800,908 | | 9/1998 | Hobson et al. . |
| 5,816,165 | | 10/1998 | Huston . |
| 5,825,374 | | 10/1998 | Albertalli et al. . |
| 5,852,462 | | 12/1998 | Lloyd et al. . |
| 5,852,761 | | 12/1998 | Marcelletti et al. . |
| 5,853,832 | | 12/1998 | Ishikawa . |
| 5,887,235 | | 3/1999 | Wayman et al. . |
| 5,890,032 | | 3/1999 | Aslam et al. . |
| 6,016,409 | * | 1/2000 | Beard et al. ..... 399/33 |

FOREIGN PATENT DOCUMENTS

| | | | |
|---|---|---|---|
| 10-149048 | * | 6/1998 | (JP) . |

* cited by examiner

*Primary Examiner*—Joan Pendegrass
(74) *Attorney, Agent, or Firm*—Taylor & Aust, P.C.

(57) ABSTRACT

A multi-level oiling device drive mechanism suitable for use in an imaging apparatus is disclosed. The drive mechanism includes a prime mover and gear train mounted to a frame of the base machine. A driven member of the oiling device, such as a web take-up spool in an oil web system, is driven by the gear train. When replacement of the oiling device is required, the driven member is disconnected from the gear train, and the device is replaced, without the need for replacing the drive mechanism.

19 Claims, 4 Drawing Sheets

MULTI-LEVEL OILING DEVICE DRIVE MECHANISM

BACKGROUND OF THE INVENTION

1. Related Applications

This application relates to contemporaneously filed applications Ser. No. 09/548,922, entitled "Constant Displacement Oil Web System and Method of Operating the Same", and Ser. No. 09/548,924, entitled "Multi-Level Oiling Device and Process for a Fuser System", both of which are expressly incorporated herein by reference.

2. Field of the Invention

The present invention relates to an electrophotographic imaging apparatus, and more particularly to an oil web fuser oiling apparatus and a drive mechanism therefor.

3. Description of the Related Art

In a laser printer or similar apparatus using the electrophotographic process, an electrostatic image is created upon a photosensitive member, such as a roll or belt. Visible electroscopic marking particles, commonly referred to as toner, are applied to the electrostatic image on the photosensitive material. Thereafter, the toner is transferred to the desired media, which may include paper, transparency sheets or the like.

To make the toner image permanent on the media, the toner is fixed by the application of heat, frequently with the simultaneous application of pressure. The toner is elevated in temperature sufficiently to cause constituents of the toner to become tacky, and flow into the pores or interstices between fibers of the media. The simultaneous application of pressure can enhance the flow of the fluidized toner. Upon cooling, the toner again solidifies, causing the toner to adhere to the media.

Fixing the electroscopic toner images commonly has been accomplished by passing the media, with the toner image thereon, through a nip formed by opposed rolls, at least one of which is heated internally. The heated roll, referred to as a fuser roll, contacts the toner image, thereby heating the toner image as it passes through the nip. Under some operating conditions, the tackiness of the toner upon heating can cause the media to adhere to the fuser roll, and/or may cause a build up of toner on the fuser roll. By controlling the heat transfer to the toner, offset of toner to the fuser roll can be minimized. In a duplex imaging apparatus, wherein both sides of the media may be printed, toner offset, or media sticking problems may be enhanced. Further, toner may be transferred to the backing roll of the fuser roll couple, and transferred thereafter elsewhere in the apparatus. The presence of wayward toner particles in the imaging apparatus can degrade the quality of the printed sheets.

It is known in the electrophotographic process to reduce sticking, and toner offset to the fuser roll, by applying a release fluid to the surface of the fuser roll. The release fluid creates a weak boundary between the heated roll and the toner, thereby substantially minimizing the offset of toner to the fuser roll, which occurs when the cohesive forces in the toner mass are less than the adhesive forces between the toner and the fuser roll. Silicone oils having inherent temperature resistance and release properties suitable for the application are commonly used as release fluids. A known, available silicone oil that has been used advantageously in the past is polydimethylsiloxane.

A variety of fuser roll oiling systems have been used in the past, including oil wicking systems, oil delivery rolls and oil webs. Oil wicking systems include reservoir tanks of the desired release agent or oil, and a piece of fabric wick material having one end mounted in the reservoir and the other end spring biased against the hot roll. Oil from the reservoir is drawn through the fabric wick by capillary action, and is deposited against the roll surface. While a wicking system can be effective in supplying oil to the fuser roll, surface deposit of the oil on the roll can be inconsistent. and the replenishment or replacement of the oil and/or system can be difficult and messy.

An oil delivery roll system commonly includes an oil delivery roll nipped against the hot fuser roll, and either freely rotating against the fuser roll or driven against the roll through a gear train. Oil, delivered by various means to the surface of the oil delivery roll, is deposited on the hot fuser roll as the rolls rotate against each other. Various structures have been used for providing oil to the surface of the oil delivery roll, including reservoirs at the center of the roll providing oil to the roll surface through tubes or by means of capillary action in the outer material. Felts or metering membranes may be used in the oil delivery roll to control the oil flow through the roll. Another style of oil delivery roll, referred to as a web wrapped roll, includes high temperature paper or non-woven material saturated with oil, and wrapped around a metal core. In yet another type of oil delivery roll, a solid, oil secreting silicone rubber is used on the surface of the roll. The oil slowly secretes from the rubber and is deposited on the surface of the hot roll, without the need for a separate oil reservoir or metering layers.

Commonly used oil web systems include a supply spool of web material, generally being a fabric of one or more layers saturated with the desired oil. Non-woven fabrics of polyester and aramid fibers, such as Nomex® manufactured by DuPont, have been used satisfactorily in oil web systems in the past. A take-up spool is provided for receiving the used web. A web path, commonly including one or more guide rolls, extends from the supply spool to the take-up spool. A portion of the web path brings the web material into contact with the hot fuser roll, either by wrapping a portion of the web around the hot roll, or by utilizing a spring-loaded idler roll to nip the web material against the fuser roll. As the fuser roll rotates against the web in contact therewith, oil is transferred from the web to the fuser roll. Periodically, a drive mechanism for the take-up spool activates, rotating the spool and advancing web material from the supply spool to the take-up spool, thereby bringing a fresh section of web material into contact with the fuser roll.

Such conventional oil web systems can be used to deliver oil at a relatively constant rate with good uniformity. However, the oil flow is dependent on the amount of material brought into contact with the fuser roll over a given period of time. In conventional oil web systems, the simplified drive mechanisms for the take-up spool are attached to the fuser unit, or to the oil delivery apparatus, and have been operated for consistent durations at constant intervals throughout the life of the web system. Therefore, as spent material passes onto the take-up spool, and the diameter of the take-up spool increases, the length of web material brought into contact with the fuser roll increases during each web indexing procedure, thereby increasing the amount of oil deposited on the fuser roll.

Further, oil wicking systems, oil delivery rolls and oil web systems previously known in the art were designed only for a single oil delivery rate. By necessity, the delivery rate had to be for the maximum oil demand for the print processes to be performed and the media types to be used in the imaging apparatus. This often resulted in the over-application of oil under some conditions.

Improved oil web systems are described in co-pending patent applications entitled "Constant Displacement Oil Web System And Method For Operating The Same" and "Multi-Level Oiling Device And Process For A Fuser System", filed on even date herewith, and commonly assigned to Lexmark International, Inc. In the improved systems described in the aforementioned co-pending patent applications, an oil web device is disclosed in which the problem of the incremental increase in the linear advancement of the web as the take-up spool diameter increases has been solved by adjustment of the drive mechanism operating cycle. Further, the rate of oil application to the fuser roll can be varied dependent upon the media type being processed, and/or the desired glossiness of the printed image on the sheet. Media sticking and toner offset problems can be minimized without over-application of oil. Waste of the oil web system has been reduced substantially.

Drive mechanisms for oil web systems known in the past commonly have been mounted to the fuser unit or to the oil web unit; and, therefore, would be replaced when the respective unit to which it was attached would be replaced. Typically, the fuser unit and the oil web unit are considered to be replaceable units, each having a life expectancy less than the overall life expectancy of the base machine. Periodic replacement of each is necessary and expected. However, the drive mechanism for the oil web system can have a life expectancy equal to that of the base machine, and replacement may not be necessary during the expected machine life. Therefore, replacement of the drive mechanism with the fuser or oil web unit to which it is attached is wasteful and costly to the consumer.

Further, the drive mechanisms commonly used for oil web systems in the past did not provide precise control of the web advancement intervals, due to the coarse indexing control provided.

What is needed is an oiling device drive mechanism that is mounted in the base machine and is not replaced unnecessarily with units requiring periodic replacement. A further need is a multi-level oiling device drive mechanism having operating performance improvements for the more precise oil web systems currently available.

SUMMARY OF THE INVENTION

The present invention provides an imaging apparatus having a multi-level oiling device drive mechanism mounted in the base machine, with improved drive train components.

The present invention comprises a prime mover and a drive train operatively connected to the prime mover, both mounted to the base machine frame. A snap fastener secures a shaft to the oil web housing, between the drive train and the take-up spool of the oil web unit. In the preferred embodiment, the prime mover is a stepper motor, and the drive train employs a worm gear to conserve space, achieve high gear ratios and minimize backlash.

When periodic replacement of the oil web unit is required, the take-up spool is disconnected from the drive train, the old oil web unit is removed, and a new oil web unit is positioned and connected to the drive train.

An advantage of the present invention is the reduction of waste in replacement of components in an imaging apparatus, by separating longer life expectancy drive components from the shorter life expectancy components of the fuser and oil web systems in an imaging apparatus.

Another advantage of the present invention is the reduction in maintenance costs for an imaging apparatus.

Yet another advantage of the present invention is the improved performance and operation of the oil web drive mechanism.

A further advantage of the present invention is removing the drive motor and electronic controls from the fuser, and locating the motor and electronic controls in an area less heated by the hot fuser roll, with simplified electrical connections and cabling.

BRIEF DESCRIPTON OF THE DRAWINGS

The above-mentioned and other features and advantages of this invention, and the manner of attaining them, will become more apparent and the invention will be better understood by reference to the following description of the embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
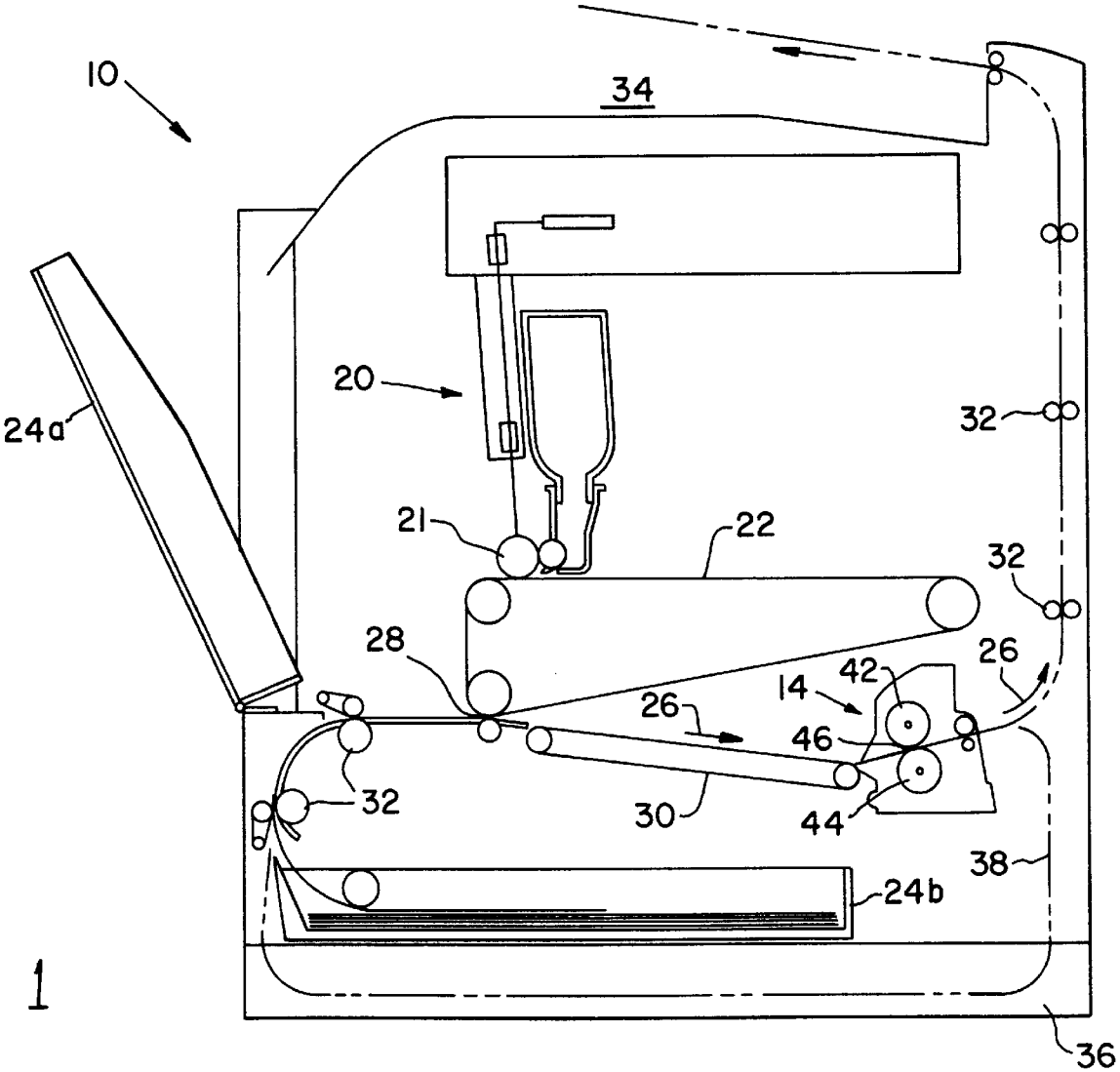
FIG. 1 is a simplified schematic representation of an imaging apparatus in which the present invention for a multi-level oiling device drive mechanism can be used advantageously.
Figure 2:
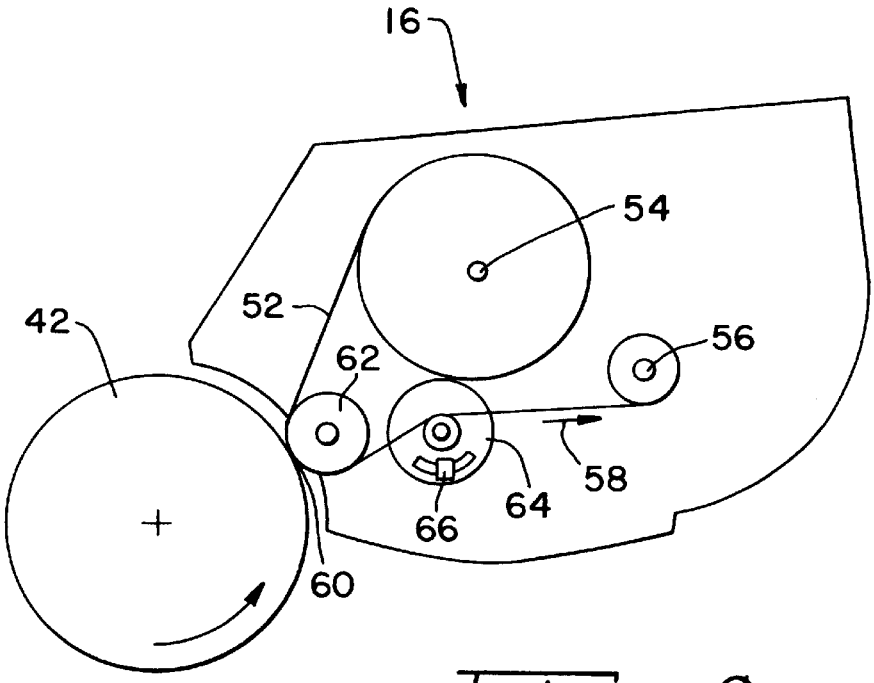
FIG. 2 is a simplified schematic representation of an oil web system from which the present invention may be used.
Figure 4:
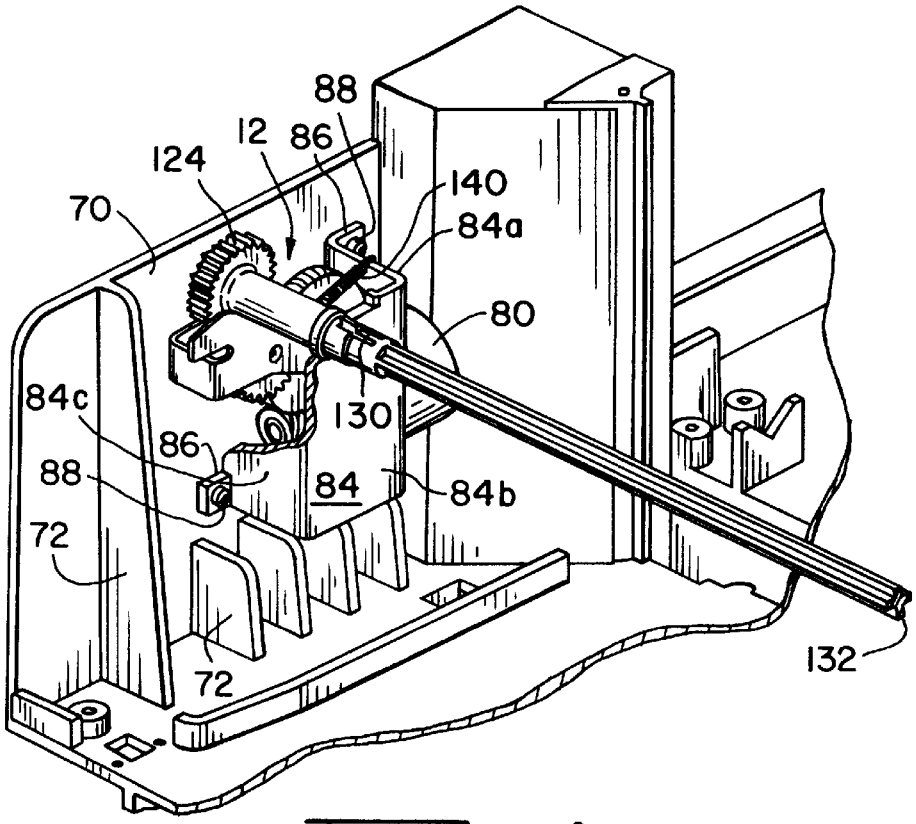
FIG. 4 is a fragmentary perspective view of an oiling device drive mechanism according to the present invention, shown mounted in an imaging apparatus frame.
Figure 5:
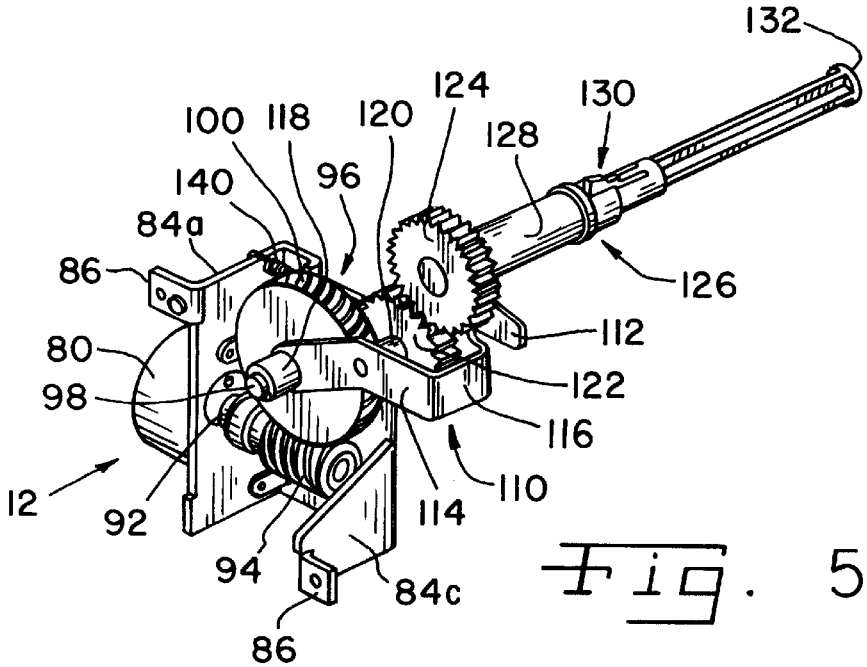
FIG. 5 is perspective view of the oiling device drive mechanism shown in FIG. 4; the device shown removed from the imaging apparatus, and the view from the opposite end of the device from the view shown in FIG. 4.
Figure 6:
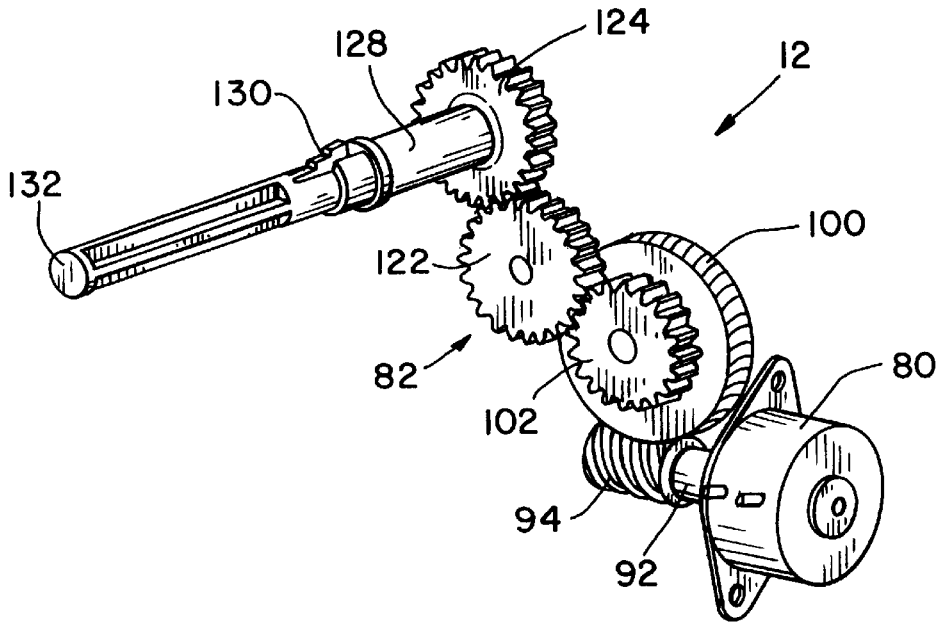
FIG. 6 is a perspective view of the gear train for the oiling device drive mechanism shown in FIG. 4 and FIG. 5.

Referring now more specifically to the drawings, and particularly to FIG. 1, there is shown an imaging apparatus in the form of a laser printer 10, in which a multilevel oiling device drive mechanism 12 of the present invention, shown best in FIG. 4, FIG. 5 and FIG. 6 may be used advantageously. Printer 10 includes a fuser 14 and oil web system 16 (FIG. 2).

The printer 10 further includes a printhead 20, which, in known fashion, creates an electrostatic image on a photoconductor drum 21. The image is then transferred on to an image transfer belt 22. Media supplied from one of a media supply tray 24*a* or 24*b* is moved along a media path indicated in the drawings by the arrows 26, which includes processing through an image transfer nip 28 and the fuser 14. The media path includes a plurality of guide surfaces or belts 30 and/or guide rolls 32 to direct the media through the printer, ending at a media receiving zone 34. The media path may further include a duplexing side path including a duplexing tray 36 and an alternate path indicated by dashed line 38, whereby the paper is reversed, for printing on both sides thereof.

Those skilled in the art will readily understand the manner in which printhead 20 creates an electrostatic image on a photosensitive member, such as photoconductor drum 21. The image is further processed by the attachment of toner particles, which in a color printer may include particles of different colors. Thereafter, the toner image is transferred to image transfer belt 22, then to the media sheets at image transfer nip 28. The sheet is processed thereafter through fuser 14, wherein the image is fixed through the application of heat and pressure.

Fuser 14 includes a fuser hot roll 42 and a fuser backing roll 44, creating a fuser nip 46 through which the media passes. Heat and pressure are applied to the media as it passes through fuser nip 46. A fuser roll oiling system, of which oil web system 16 is one suitable construction, is provided to prevent sticking tendencies between the media and hot roll 42, and to minimize toner offset to hot roll 42. Oil web system 16 applies a release agent, such as silicone oil, to the surface of hot roll 42. As is known, the oil on the surface of hot roll 42 alleviates the sticking and toner offset problems that can be encountered.

Referring now to FIG. 2, oil web system 16 includes a web 52 of suitable material for carrying release agent. A non-woven fabric of polyester and aramid fibers, such as Nomex® manufactured by and available from DuPont, has been used advantageously in the past. The material is coated or saturated with a release agent, such as a silicone oil of polydimethylsiloxane or the like. Web 52 is a relatively thin elongated band stored on a supply spool 54 prior to its use in oil web system 16. A take-up spool 56 is provided for receiving used or spent portions of web 52. Between supply spool 54 and take-up spool 56, web 52 extends along a web path designated by arrows 58. The web path is defined by web guiding members, including supply spool 54, take-up spool 56 and other guide rolls or guide surfaces. Along at least a portion of the web path, web 52 is brought into contact with hot roll 42 of fuser 14. Release agent is transferred from web 52 to hot roll 42 at an oil transfer nip 60. In the embodiment shown, oil transfer nip 60 is created by the close proximity of a spring-loaded biasing roll 62 to hot roll 42, which holds web 52 against hot roll 42 at oil transfer nip 60. It should be understood that other arrangements can be used advantageously to bring portions of web 52 into contact with hot roll 42. For example, two or more rolls may be used to position web 52 such that a segment of web 52 wraps a portion of hot roll 42. Alternatively, the relative positions of a single idler roll and take-up spool 56 may be such as to cause a portion of web 52 to wrap a portion of hot roll 42. Oil web system 16 further includes an encoder wheel 64 and sensor 66 of known design to determine actual linear advancement of web 52.

In oil transfer nip 60, or other transfer area at which oil is deposited on hot roll 42, the surface of hot roll 42 and web 52 move in opposite directions. Tension is applied to web 52 between biasing roll 62 and take-up spool 56, and, therefore, roll up of web 52 on take-up spool 56 is under tension. Tension in the roll up creates a neat, clean wind up of the material on take-up spool 56. Further, tension is relieved from the segment of the web 52 between supply spool 54 and biasing roll 62, to prevent unintentional unwind and any resultant over application of oil on hot roll 42.

Since the electrophotostatic imaging process, and the apparatuses referenced and described thus far, are old and readily understood by those skilled in the art, further details thereof will not be provided herein.

It should be recognized that laser printer 10 shown in FIG. 1 is merely the representation of a suitable apparatus in which the present invention may be used advantageously. It should be further understood that other types of laser printers, other types of printers generally, and other types of imaging apparatus may advantageously use the present invention as well. Printer 10, shown in FIG. 1, is merely one such device provided and described herein for ease of understanding the use of the present invention, and should not be considered as a limitation on the invention, nor on the claims to follow.

To effect transfer of web 52 from supply spool 54 to take-up spool 56, drive mechanism 12 is provided. Drive mechanism 12 is mounted in printer 10 by attachment to a portion of a base machine frame 70 of printer 10. Frame 70 may include reinforcement ribs 72 or the like. Drive mechanism 12 includes a prime mover 80 and a drive train in the form of a gear train 82 mounted in a bracket 84. Bracket 84 is a channel-like piece having wall segments 84*a*, 84*b* and 84*c*, and additionally having a plurality of ears or tabs 86 which are attached to machine frame 70 by a plurality of fasteners such as screws 88, bolts and complimentary nuts, snap type connectors or other suitable means. The bracket and fasteners may be of plastic, metal or other suitable rigid material for securing prime mover 80 and gear train 82 in proper operational position, while minimizing undo flexing and distortion. The various components of drive train 82, to be described hereinafter, also may be of plastic, metal or other suitable material.

Prime mover 80, as shown, is a stepper motor activated and deactivated in known manner by a controller, not shown. It should be understood that prime mover 80 also may be a solenoid, an encoder pulsed direct current motor, or other suitably accurate and signal controlled positional actuator.

Stepper motor prime mover 80 is attached to wall 84*a* of bracket 84 by screws, bolts or the like, not shown. An output shaft 92 of stepper motor prime mover 80 extends through wall 84*a* of bracket 84. A worm gear 94 is mounted by conventional means on output shaft 92, for direct rotation thereby.

A compound gear 96 is mounted on a spindle 98 attached to wall 84*b* of bracket 84. Compound gear 96 includes a helical gear portion 100 operatively positioned to be driven by worm gear 94. A second component of compound gear 96 is a spur gear portion 102 (FIG. 6). Compound gear 96 advantageously is a single body having helical gear and spur gear components, and spindle 98 is fixed, with compound gear 96 mounted for rotation thereon. Alternatively, helical gear 100 and spur gear 102 of the compound gear 96 may be individual components fixedly mounted on a shaft suitably journaled in bracket 84 for rotation.

A swing arm 110, generally being a u-shaped member, is mounted on spindle 98. Swing arm 110 includes side segments 112 and 114, and an end portion 116 between the side segments 112 and 114. Side segment 112 is positioned on spindle 98 against wall 84*b* of bracket 84, and side segment 114 of swing arm 110 is secured on spindle 98 by a retainer sleeve 118. Swing arm 110 thereby brackets compound gear 96, which can rotate on spindle 98 between swing arm side segments 112 and 114.

A shaft 120 is disposed between side segments 112 and 114 of swing arm 110. A spur gear 122 is disposed on shaft 120, and is operationally engaged with spur gear 102 of compound gear 96. Spur gear 122 may be mounted for rotation on shaft 120, which remains fixed, or spur gear 122 may be fixed on shaft 120, which is mounted for rotation in side segments 112 and 114 of swing arm 110. Spur gear 122 engages a spur gear 124 disposed on a shaft 126, when swing arm 110 is in an elevated position. Side segment 112 of swing arm 110 is positioned against shaft 126 when swing arm 110 is operationally rotated upwardly. The contact between side segment 112 and shaft 126 automatically establishes a well-controlled center distance between spur gear 122 and spur gear 124.

Shaft 126 extends away from spur gear 124, and includes a journal surface 128, having a snap securing feature 130 located in proximity thereto. A distal end 132 of shaft 126 is received by hollow take-up spool 56 of oil web system 16, which is held for driving engagement by shaft 126.

Figure 7:
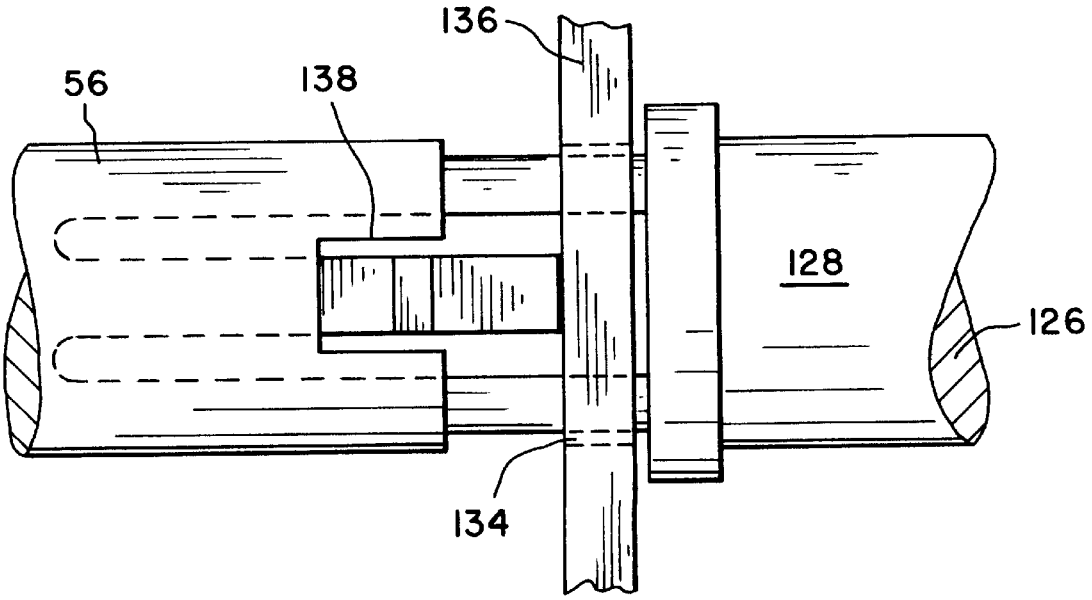
FIG. 7 is an enlarged plan view of a portion of the present mechanism, in the installed, operating position.

Referring now to FIG. 7, it can be seen how shaft 126, journal surface 128, snap securing feature 130 and distal end 132 are associated with oil web system 16, when properly installed. Distal end 132 and journal surface 128 are inserted through an opening 134 in a housing wall 136 of oil web system 16. Snap securing feature 130 deflects as it passes through opening 134, expanding after having cleared housing wall 136, thereby securing the position of shaft 126 relative to wall 136. A channel or key way 138 is provided in take-up spool 56, and snap securing feature 130 is positioned therein for a more positive driving relationship between shaft 126 and take-up spool 56. Additional or other keys and key ways, or other driving engagement securing constructions may be provided between shaft 126 and take-up spool 56.

A spring 140 urges swing arm 110 upwardly, allowing initial engagement and meshing of spur gears 122 and 124. After load is applied, reaction forces due to gear teeth meshing cause a moment on swing arm 110 to maintain gear meshing.

Figure 3:
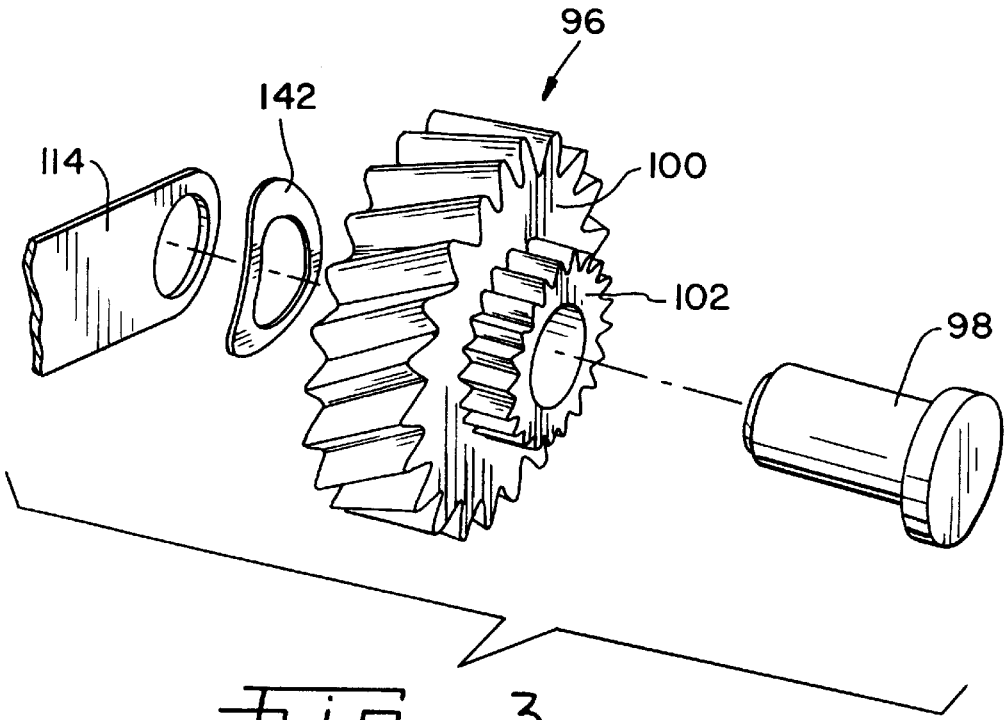
FIG. 3 is an enlarged, exploded view of a swing arm assembly in the present invention.

In an alternative construction to position swing arm 110, shown in FIG. 3, a thrust washer 142, or other frictional filler connection is provided on spindle 98 between swing arm side segment 114 and compound gear 96. Compound gear 96, will move swing arm 110 upwardly when compound gear 96 is rotated counter-clockwise as shown in FIG. 5; and will move swing arm 110 downwardly when compound gear 96 is rotated clockwise. Thrust washer 142 allows compound gear 96 to move swing arm 110 when little interference to movement is encountered. However, when a certain level of interference to movement of swing arm 110 is encountered, compound gear 96 will slip against thrust washer 142.

In the use and operation of a multi-level oiling device drive mechanism of the present invention stepper motor prime mover 80 is activated by a drive mechanism controller, not shown. Activation will occur when the controller has determined a need for advancement of web 52, to bring a fresh portion of web 52 into contact with hot roll 42. This determination may be made with multiple data inputs regarding the use of printer 10, the media being used, desired print characteristics and the like.

Operation of stepper motor prime mover 80 and output shaft 92 turns worm gear 94, which in turn drives helical gear portion 100 of compound gear 96. Spur gear portion 102 of compound gear 96 drives spur gear 122 mounted in swing arm 110. Spur gear 122 drives spur gear 124, when properly engaged therewith, and thereby rotates distal end 132 of shaft 126. Take-up spool 56, drivingly engaged with shaft 126, draws web 52 along the web path, to bring fresh portions of web 52 from supply spool 54 into contact with hot roll 42 at oil transfer nip 60.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus comprising;

a machine frame;

a fuser section having a fuser roll;

a fuser roll oiling system; and a drive mechanism for said fuser roll oiling system, said drive mechanism being attached to said machine frame and drivingly connected to said fuser roll oiling system, and said drive mechanism being separately replaceable from said fuser section and said fuser roll oiling system.

2. The imaging apparatus of claim 1, wherein said fuser roll oiling system includes an oil web.

3. The imaging apparatus of claim 2, wherein said drive mechanism includes a drive train which is selectively engaged with and disengaged from said fuser roll oiling system.

4. The imaging apparatus of claim 2, wherein said drive mechanism comprises a stepper motor mounted to said machine frame; a worm gear operatively connected to and driven by said stepper motor; and a gear train operatively disposed between said worm gear and said fuser roll oiling system.

5. The imaging apparatus of claim 4, wherein said fuser roll oiling system includes a take-up spool connected to said gear train.

6. The imaging apparatus of claim 5, further comprising a driven shaft drivingly engaged with said take-up spool.

7. The imaging apparatus of claim 1, wherein said drive mechanism includes a drive train selectively engaged with and disengaged from said fuser roll oiling system.

8. The imaging apparatus of claim 1 wherein said drive mechanism comprises a stepper motor mounted to said machine frame; a worm gear operatively connected to and driven by said stepper motor; and a gear train operatively disposed between said worm gear and said fuser roll oiling system.

9. An imaging apparatus comprising:

a machine frame;

a fuser section having a fuser roll;

a fuser roll oiling system; and a drive mechanism for said fuser roll oiling system, said drive mechanism being attached to said machine frame and separately replaceable from said fuser section and said fuser roll oiling system; and wherein said drive mechanism includes a gear train having at least a first gear and a second gear, a swing arm carries said first gear, and said swing arm is selectively operable to engage and disengage said first gear and said second gear.

10. The imaging apparatus of claim 9, wherein said swing arm is adapted for movement between a first position and a second position, and said swing arm is adapted and arranged for movement by said gear train.

11. A drive mechanism for a removable oil web system having an oil web take-up spool, in an imaging apparatus having a machine frame, said drive mechanism comprising a prime mover mounted to the machine frame; a drive train mounted to the machine frame and operatively connected to and driven by said prime mover; and a coupling for connecting and disconnecting said drive train to the oil web take up spool for removal of said oil web system.

12. The drive mechanism of claim 11, wherein said prime mover comprises a stepper motor.

13. The drive mechanism of claim 11, wherein said drive train includes a worm gear.

14. The drive mechanism of claim 11, wherein said prime mover comprises a direct current motor.

15. The drive mechanism of claim 11, wherein said prime mover comprises a solenoid.

16. A drive mechanism for an oil web system having an oil web take-up spool, in an imaging apparatus having a machine frame, said drive mechanism comprising a prime mover mounted to the machine frame; a drive train mounted to the machine frame and operatively connected to and driven by said prime mover; and a coupling for connecting and disconnecting said drive train to the oil web take up spool, wherein said drive train includes a moveable gear, for selectively establishing and disestablishing driving connection in said drive train.

17. A drive mechanism for an oil web system having an oil web take-up spool, in an imaging apparatus having a machine frame, said drive mechanism comprising a prime mover mounted to the machine frame; a drive train mounted to the machine frame and operatively connected to and driven by said prime mover; and a coupling for connecting and disconnecting said drive train to the oil web take up spool, wherein said drive train comprises a gear train having at least a first gear and a second gear, and further including a swing arm to selectively engage and disengage said first gear and sid second gear.

18. The drive mechanism of claim 17, wherein said swing arm frictionally engages at least one gear of said gear train, and is rotatively driven by said at least one gear.

19. A method for replacing a fuser roll oiling system in an imaging apparatus, having a first fuser roll oiling system operatively installed therein; comprising steps of:

providing a second fuser roll oiling system;

disconnecting a driven member of the first fuser roll oiling system from a machine mounted drive mechanism in the imaging apparatus;

removing the first fuser roll oiling system from the imaging apparatus;

positioning the second fuser roll oiling system in the imaging apparatus;

connecting a driven member of the second fuser roll oiling system to the machine mounted drive mechanism; and operating a swing arm to selectively engage and disengage gears of a gear train in said drive mechanism.

* * * * *